US011808167B2

(12) United States Patent
Fanelli et al.

(10) Patent No.: US 11,808,167 B2
(45) Date of Patent: Nov. 7, 2023

(54) TURBINE ENGINE BLADE PROVIDED WITH AN OPTIMIZED COOLING CIRCUIT

(71) Applicant: SAFRAN AIRCRAFT ENGINES, Paris (FR)

(72) Inventors: Jérémy Jacques Attilio Fanelli, Moissy-Cramayel (FR); Romain Pierre Cariou, Moissy-Cramayel (FR); Vianney Simon, Moissy-Cramayel (FR); Ba-Phuc Tang, Moissy-Cramayel (FR)

(73) Assignees: SAFRAN AIRCRAFT ENGINES, Paris (FR); SAFRAN, Paris (FR)

( * ) Notice: Subject to any disclaimer, the term of this patent is extended or adjusted under 35 U.S.C. 154(b) by 143 days.

(21) Appl. No.: 17/439,340

(22) PCT Filed: Mar. 16, 2020

(86) PCT No.: PCT/FR2020/050566
§ 371 (c)(1),
(2) Date: Sep. 14, 2021

(87) PCT Pub. No.: WO2020/193913
PCT Pub. Date: Oct. 1, 2020

(65) Prior Publication Data

US 2022/0178261 A1 Jun. 9, 2022

(30) Foreign Application Priority Data

Mar. 22, 2019 (FR) ..... 1903017

(51) Int. Cl.
*F01D 5/18* (2006.01)

(52) U.S. Cl.
CPC ..... *F01D 5/18* (2013.01); *F05D 2220/32* (2013.01); *F05D 2240/30* (2013.01); *F05D 2260/20* (2013.01)

(58) Field of Classification Search
CPC ..... F01D 5/187; F01D 5/186; F01D 25/12; F01D 5/18; F01D 9/02; F01D 5/147;
(Continued)

(56) References Cited

U.S. PATENT DOCUMENTS 6,969,230 B2 * 11/2005 Shi ..... F01D 5/187 415/115
7,670,112 B2 * 3/2010 Boury ..... F01D 5/186 416/97 R
2013/0259645 A1 10/2013 Bergholz, Jr. et al.

FOREIGN PATENT DOCUMENTS

EP 1 267 039 A1 12/2002
EP 1 793 083 A2 6/2007
(Continued)

OTHER PUBLICATIONS

International Search Report dated Aug. 14, 2020, issued in corresponding International Application No. PCT/FR2020/050566, filed Mar. 16, 2020, 7 pages.
(Continued)

*Primary Examiner* — Eric J Zamora Alvarez
(74) *Attorney, Agent, or Firm* — CHRISTENSEN O'CONNOR JOHNSON KINDNESS PLLC

(57) ABSTRACT

A turbine engine blade includes an airfoil with a pressure-side wall and a suction-side wall which are connected upstream by a leading edge and downstream by a trailing edge. A cooling circuit has an internal cavity extending inside the airfoil and a plurality of outlet openings, each oriented substantially along a longitudinal axis X. Each outlet opening communicates with the cavity and is arranged in the vicinity of the trailing edge. A calibration device is arranged in the cavity and provided with calibration conduits arranged substantially opposite the outlet openings. The
(Continued)

calibration conduits each include an oblong transverse section which is substantially perpendicular to the longitudinal axis.

10 Claims, 3 Drawing Sheets

(58) Field of Classification Search
CPC . F01D 5/20; F01D 11/08; F01D 5/188; F01D 9/065; F01D 5/085; F01D 5/141; F05D 2260/20; F05D 2220/32; F05D 2260/202; F05D 2240/30; F05D 2240/304; F05D 2260/22141; F05D 2250/14; F05D 2260/2212; F05D 2240/122; F05D 2260/2214; F05D 2240/301; F05D 2250/141; F05D 2250/70; F05D 2250/71; F05D 2240/127; F05D 2250/231
See application file for complete search history.

(56) References Cited

FOREIGN PATENT DOCUMENTS

| | | |
|---|---|---|
| EP | 3 176 376 A1 | 6/2017 |
| WO | 2017/153687 A1 | 9/2017 |

OTHER PUBLICATIONS

Written Opinion dated Aug. 14, 2020, issued in corresponding International Application No. PCT/FR2020/050566, filed Mar. 16, 2020, 5 pages.
English translation of Written Opinion dated Aug. 14, 2020, issued in corresponding International Application No. PCT/FR2020/050566, filed Mar. 16, 2020, 2020, 4 pages.
International Preliminary Report on Patentability dated Sep. 28, 2021, issued in corresponding International Application No. PCT/FR2020/050566, filed Mar. 16, 2020, 6 pages.

* cited by examiner

TURBINE ENGINE BLADE PROVIDED WITH AN OPTIMIZED COOLING CIRCUIT

FIELD OF THE DISCLOSURE

The present disclosure relates to the field of the turbine engines and in particular to a turbine engine vane equipped with a cooling circuit intended to cool it.

BACKGROUND

The prior art comprises the documents EP-A2-1 793 083, EP-A1-1 267 039 and US-A1-2013/259645.

The turbine engine vanes, in particular the high-pressure turbine vanes, are subjected to very high temperatures that can shorten their service life and degrade the performance of the turbine engine. Indeed, the turbine engine turbines are arranged downstream of the combustion chamber of the turbine engine, which ejects a hot gas flow that is expanded by the turbines and allows them to be driven in rotation for the operation of the turbine engine. The high-pressure turbine, which is located directly at the outlet of the combustion chamber, is subject to the highest temperatures.

In order to allow the turbine vanes to withstand these severe thermal stresses, it is known to provide a cooling circuit in which relatively cooler air circulates, which is taken at the level of the compressors, the latter being located upstream of the combustion chamber. More specifically, each turbine vane comprises a blade with a pressure side surface and a suction side surface which are connected upstream by a leading edge and downstream by a trailing edge. The cooling circuit comprises a cavity located inside the vane and opening into orifices which are located in the vicinity of the trailing edge. These orifices deliver cooling air jets to the walls of the blade.

However, the orifices are not supplied with air evenly. A calibration device has been developed to ensure that the majority of the cooling air flow is delivered only to the first orifice which is radially closest to the root of the vane. This calibration device comprises a partition which is provided with holes and which is placed in the cooling air path upstream of the orifices. These holes allow each orifice to produce a localized jet that will cool the pressure side surface.

However, the holes of this calibration device are extremely loaded mechanically due to local thermal gradients, the centrifugal force linked to the rotation of the vane which introduces tensile stresses, and the geometry of the holes which induces a stress concentration factor "Kt".

SUMMARY

The objective of the present disclosure is to reduce the mechanical stresses that suffer in particular the holes of the device for calibrating the cooling air while avoiding significant structural modifications to the device itself and to the vane.

This is achieved in accordance with the disclosure by a turbine engine vane comprising:

- a blade with a pressure side wall and a suction side wall which are connected upstream by a leading edge and downstream by a trailing edge,
- a cooling circuit which comprises an internal cavity extending inside the blade and a plurality of outlet orifices each oriented substantially along a longitudinal axis X, each outlet orifice communicating with the internal cavity and being arranged in the vicinity of the trailing edge, and
- a calibration device arranged in the internal cavity and provided with calibration conduits which are arranged substantially opposite the outlet orifices, the calibration conduits each comprising an oblong or substantially oblong transverse section which is substantially perpendicular to the longitudinal axis.

Thus, this solution allows to achieve the above-mentioned objective. In particular, the particular shape of the calibration conduits allows a strong reduction of the mechanical stresses, and in particular of the static stresses and to increase the radius of the section of the conduit while remaining at iso section, thus at iso flow rate. The load is distributed between the elongated ends of the hole, which increases the contact area of the hole and further reduces the stress. Such a shape allows also to limit the risk of recrystallization of the grains of the material of which the calibration device and the vane are made. Finally, this configuration allows a gain in mass compared to the conventional solutions consisting of increasing the thickness (and therefore the mass) of the partition of the calibration device.

The vane also comprises one or more of the following characteristics, taken alone or in combination:

- the calibration device comprises a calibration cavity arranged downstream of the calibration conduits, the calibration cavity being in fluid communication with the calibration conduits and the outlet orifices.
- the calibration conduits are carried by a partition extending radially in the blade and forming upstream the internal cavity and downstream the calibration cavity which forms a reservoir.
- each calibration conduit comprises a first straight portion and a second rectilinear portion which are opposed along a predetermined width passing through the central axis of each conduit.
- each first and second rectilinear portion extends over a distance d of the order of 0.2 mm.
- each calibration conduit extends over a predetermined height and comprises a first end and a second rounded end which are opposite along the predetermined height.
- the ratio of the predetermined height to the predetermined width is between 0.5 and 2.5.
- each calibration conduit comprises circular arc portions each having a first radius R1 and which are symmetrical with respect to a first median plane passing through the central axis and perpendicular to the width L, and which are symmetrical with respect to a second median plane passing through the central axis and perpendicular to the predetermined height H.
- the first and second ends are rounded along a circular arc of a second radius R2, the value of the second radius R2 being less than that of the first radius R1.
- the value of the first radius R1 is equal to twice a nominal radius R0 of a calibration conduit with a circular section, the circular section having a passage area equal to that of the transverse section of the calibration conduit with an oblong-shaped section.
- the central axis is determined by the middle of the predetermined height and width of each calibration conduit.

The disclosure also relates to a turbine engine turbine comprising at least one turbine engine vane having the above characteristics.

The disclosure further relates to a turbine engine comprising at least one turbine engine turbine as aforesaid.

DESCRIPTION OF THE DRAWINGS

The disclosure will be better understood, and other purposes, details, characteristics and advantages thereof will become clearer upon reading the following detailed explanatory description of embodiments of the disclosure given as purely illustrative and non-limiting examples, with reference to the appended schematic drawings in which.

DETAILED DESCRIPTION

Figure 1:
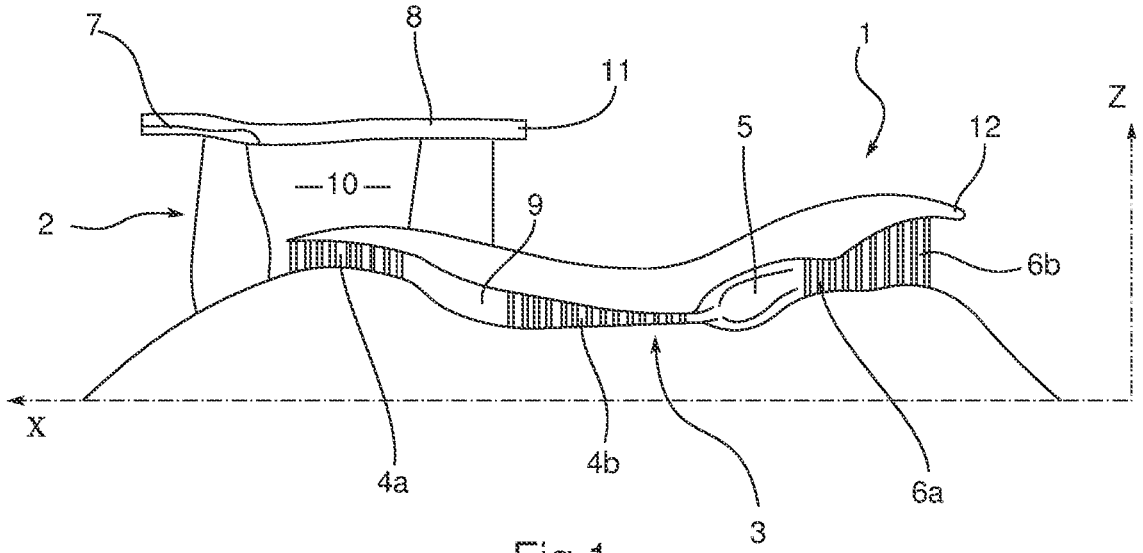
FIG. 1 is a partial axial sectional view of an example of a turbine engine to which the disclosure applies.

FIG. 1 shows an axial sectional view of a turbine engine 1 of longitudinal axis X to which the disclosure applies. The turbine engine shown is a double-flow and two-spool turbine engine intended to be mounted on an aircraft according to the disclosure. Of course, the disclosure is not limited to this type of turbine engine.

This turbine engine 1 with double-flow generally comprises a fan 2 mounted upstream of a gas generator 3. In the present disclosure, and in general, the terms "upstream" and "downstream" are defined with respect to the flow of gases in the turbine engine and here along the longitudinal axis X (and even from left to right in FIG. 1). The terms "axial" and "axially" are defined with respect to the longitudinal axis X. Similarly, the terms "radial", "internal" and "external" are defined with respect to a radial axis Z perpendicular to the longitudinal axis X and with respect to the distance from the longitudinal axis X.

The gas generator 3 comprises, from upstream to downstream, a low-pressure compressor 4*a*, a high-pressure compressor 4*b*, a combustion chamber 5, a high-pressure turbine 6*a* and a low-pressure turbine 6*b*.

The fan 2, which is surrounded by a fan casing 7 carried by a nacelle 8, divides the air entering the turbine engine into a primary air flow which passes through the gas generator 3 and in particular in a primary duct 9, and into a secondary air flow which circulates around the gas generator in a secondary duct 10.

The secondary air flow is ejected by a secondary nozzle 11 terminating the nacelle while the primary air flow is ejected outside the turbine engine via an ejection nozzle 12 located downstream of the gas generator 3.

The high-pressure turbine 6*a*, like the low-pressure turbine 6*b*, comprises one or more stages. Each stage comprises a stator blade ring mounted upstream of a mobile blade ring. The stator blade ring comprises a plurality of stator or fixed vanes, referred to as distributor, which are distributed circumferentially about the longitudinal axis X. The moving blade ring comprises a plurality of moving vanes which are equally circumferentially distributed around a disc centered on the longitudinal axis X. The distributors deflect and accelerate the aerodynamic flow leaving the combustion chamber towards the mobile vanes so that the latter are driven in rotation.

Figure 2:
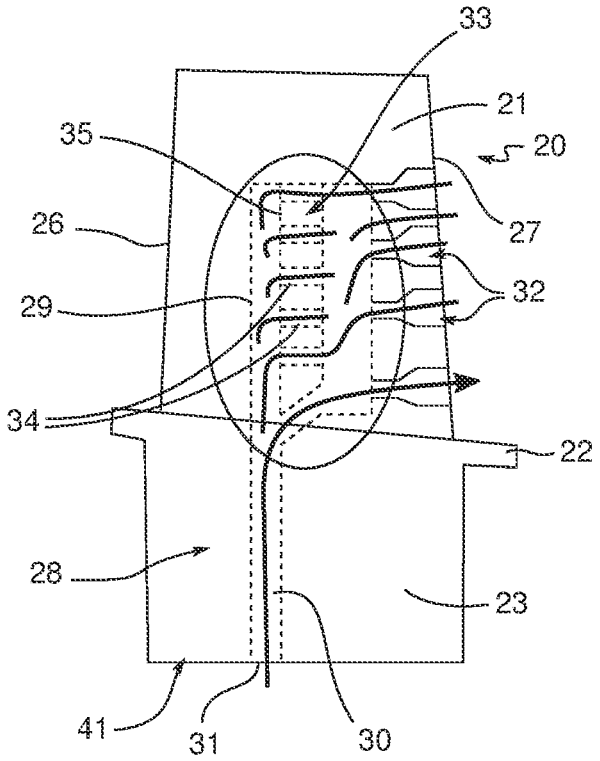
FIG. 2 is a schematic view in axial section of an example of a turbine engine vane according to the disclosure.
Figure 3:
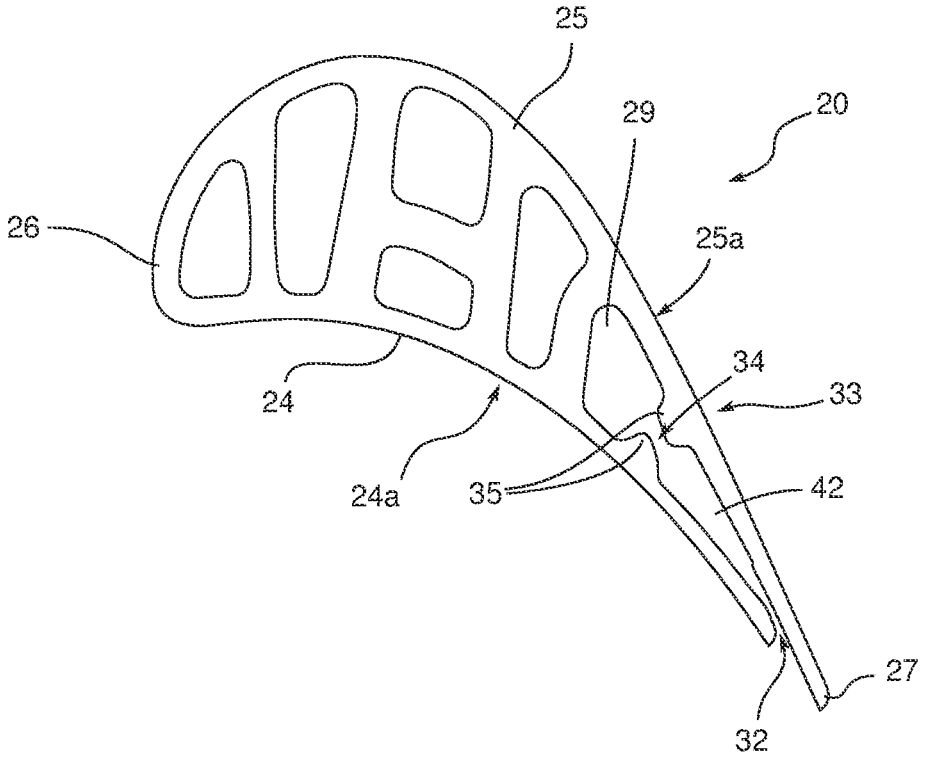
FIG. 3 is a transverse sectional view of a cooled turbine engine vane equipped with a device for calibrating a cooling air intended to be ejected through orifices at the level of its trailing edge.

With reference to FIGS. 2 and 3, each turbine vane (and here a high-pressure turbine mobile vane 20) comprises a blade 21 rising radially from a platform 22. The latter is carried by a root 23 which is intended to be implanted in one of the corresponding grooves of the turbine disc. Each blade 21 comprises a pressure side wall 24 and a suction side wall 25 which are connected upstream by a leading edge 26 and downstream by a trailing edge 27. The pressure side wall (with a pressure side surface 24*a*) and the suction side wall (with a suction side surface 25*a*) are opposite each other along a transverse axis which is perpendicular to the longitudinal and radial axes.

The vane 20 comprises a cooling circuit 28 intended to cool the walls of the blade subjected to the high temperatures of the primary air flow passing through the combustion chamber 5 and leaving the combustion chamber. The cooling circuit 28 comprises an internal cavity 29 which extends radially inside the blade, and in particular between the pressure side wall 24 and the suction side wall 25. The root 23 comprises a supply channel 30 which comprises a cooling fluid inlet 31 (here cooling air) taken from upstream of the combustion chamber such as from the low-pressure compressor and which opens into the cavity 29. The channel 30 also opens onto a radially internal face 41 of the root of the vane. The cooling circuit also comprises outlet orifices 32 that are arranged in the vicinity of the trailing edge 27 of the blade. The outlet orifices are oriented along the longitudinal axis X. Furthermore, the outlet orifices 32 are aligned and evenly distributed substantially along the radial axis.

In FIG. 3, the outlet orifices 32 are arranged in the pressure side wall 24 and open onto the pressure side surface 24*a*. In this example of embodiment, the cavity 29 is also located downstream of the blade, i.e., more towards the trailing edge.

As can also be seen in FIGS. 2 and 3, the vane comprises a calibration device 33 which is arranged in the path of the cooling air so as to regulate its flow rate. The calibration device 33 comprises a plurality of calibration conduits 34 and is advantageously arranged in the cavity 29 inside the blade. The calibration conduits 34 allow the air flow to be more evenly distributed throughout the orifices without loss of flow rate.

More specifically, the calibration device 33 comprises a partition 35 which extends along the radial axis (in the installation situation) and is defined in a median plane containing the radial axis. This partition 35 is pierced by calibration conduits 34 on either side along an axis substantially perpendicular to the median plane of the partition. The wall of the partition is about 1.5 mm thick. The conduits 34 are aligned and evenly distributed along the radial axis along the partition. Similarly, in the installation situation, the conduits 34 are substantially opposite the outlet orifices 32 of the blade. In other words, the cooling air flows substantially axially through the calibration conduits.

In the present example of embodiment and as can be seen in detail in FIG. 3, the partition 35 is formed in one piece (integral) with the blade. The partition 35 connects the pressure side wall and the suction side wall inside the cavity 29. The calibration device comprises a calibration cavity 42 which is arranged downstream of the calibration conduits 34. The calibration cavity 42 is in fluid communication with the calibration conduits and the outlet orifices. In other words, the calibration cavity 42 is arranged in the path of the cooling air towards the outlet orifices (or alternatively between the conduits 34 and the outlet orifices). In this way, the cooling air flows through the conduit 30 to the internal cavity 29 to pass through the calibration conduits 34 and then be received in the calibration cavity which acts as a reservoir. The cooling air occupying the entire calibration cavity 42 can then flow through the outlet orifices at the same flow rate. We then understand that there is a single calibration cavity 42.

Advantageously, but in a non-limiting way, the vane is made of a metal alloy and according to a manufacturing method using the lost wax casting technique. The metal alloy is preferably nickel-based and can be monocrystalline.

Figure 4:
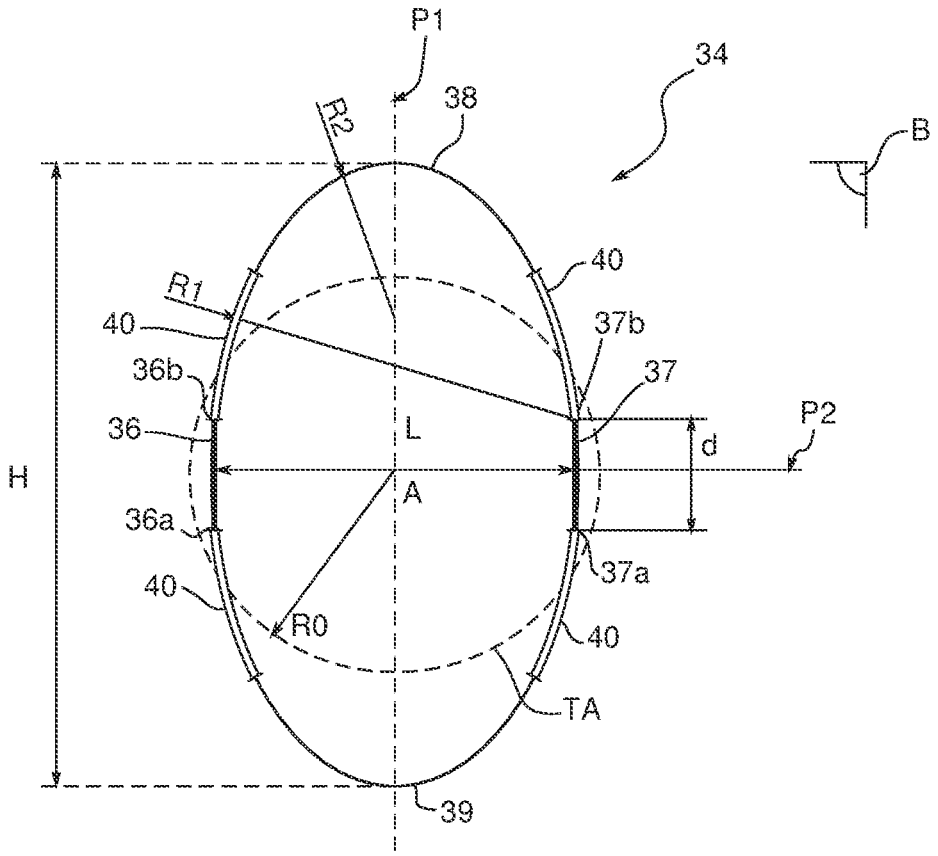
FIG. 4 is a schematic view of an example of calibration conduit of a calibration device of a turbine engine vane intended to be cooled according to the disclosure.

With reference to FIG. 4, each conduit has an oblong (or elongated or oval) or substantially oblong transverse section. In this description the term "oblong" is used to mean a shape that is longer than it is wide. In particular, the oblong conduit extends over a predetermined height H and a predetermined width L. The central axis A of each calibration conduit is determined by the intersection of the height and the width in their middle. This central axis A is perpendicular to the plane B of the partition 35. In the present example and in installation situation, the height H of the conduit 34 is aligned in a direction parallel to the radial axis while the width L is aligned in a direction parallel to the transverse axis.

The ratio between the height and the width H/L is between 0.5 and 3, and preferably between 1.4 and 2. In particular, the height H is between 1.4 times the width L and 2 times the width L. In this way, the conduits are spaced sufficiently far apart radially to reduce the static stress. The lower limit of the H/L ratio is the limit at which the gain on static stress becomes interesting.

Each conduit 34 also has two rectilinear portions referred to as "first portion" 36 and "second portion" 37 which are opposite with respect to width L passing through the central axis A. The first and the second portions 36, 37 are parallel to each other and extend along the radial axis. This configuration allows to reduce locally the stress concentration factor "kt" and thus the stress. This is because the tensile forces are exerted in a direction parallel to the radial axis. The two portions 36, 37 each extend over a distance d between a first top 36*a*, 37*a* and a second top 36*b*, 37*b*. This distance d is about 0.2 mm.

Likewise, each conduit comprises two rounded ends called "first end" 38 and "second end" 39 which are opposite to the height H passing through the central axis A.

Advantageously, but in a non-limiting way, each conduit 34 comprises a double radius so as to increase the value of the nominal radius R0 of a conventional conduit TA of circular section of the prior art (shown in dotted lines in FIG. 3). The double radius is placed where the stress is greatest on the walls or perimeters of the conduit. In particular, each conduit comprises circular arc portions 40 each having a radius R1 referred to as "first radius R1". These circular arc portions 40 are located respectively between the first and second rectilinear portions 36, 37 and the first and second rounded ends 38, 39 along the perimeter of the conduit.

We can see that there are four circular arc portions 40 of the first radius R1. The portions are symmetrical with respect to a first median plane P1 passing through the central axis and perpendicular to the width L. These portions 40 are also symmetrical with respect to a second median plane P2 passing through the central axis and perpendicular to the height H.

In the example of FIG. 4, the center of a portion 40 of the section of the conduit of radius R1 placed on one side of the median plane P2 is placed respectively on one of the ends 36*a*, 36*b*, 37*a*, 37*b* of the rectilinear portion 36, 37 which is opposite to the portion 40 with respect to the median plane P1 and the end is placed on the same side of the median plane P2 of the portion 40. Of course, a different arrangement of the centers of the radius is possible.

In this example, the value of the first radius R1 is twice the nominal radius R0 of the circular conduit. The conduit with a circular transverse section has a passage area equal to that of the transverse section of the conduit with an oblong transverse section. The value of the nominal radius R0 is about 0.35 mm.

The first and second ends 38, 39 are rounded along a circular arc with each a radius R2, called "second radius R2". In this example, the value of the second radius R2 is smaller than that of the first radius R1. In particular, the value of the second radius is equal to 0.4×R1.

For a given value of the first radius R1, the value of the distance d and the value of the second radius R2 allow to minimize the section of the conduit while ensuring a consistent first radius R1 where the stresses are important.

Figure 5:
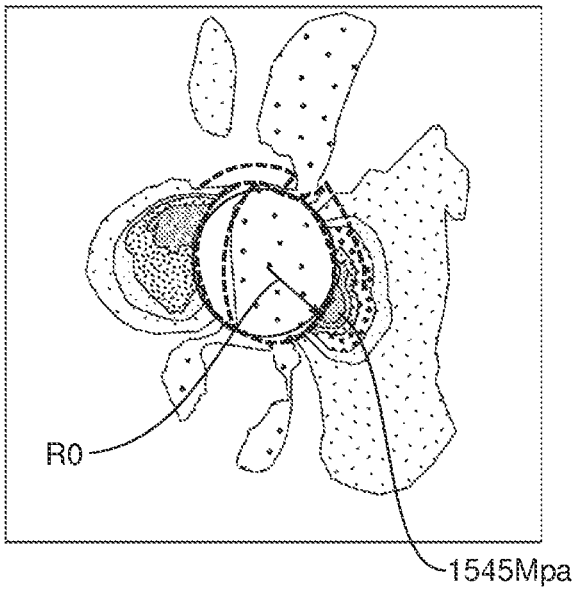
FIG. 5 illustrates a mapping of the static stresses applied to a circular section calibration conduit of a calibration device of the prior art.
Figure 6:
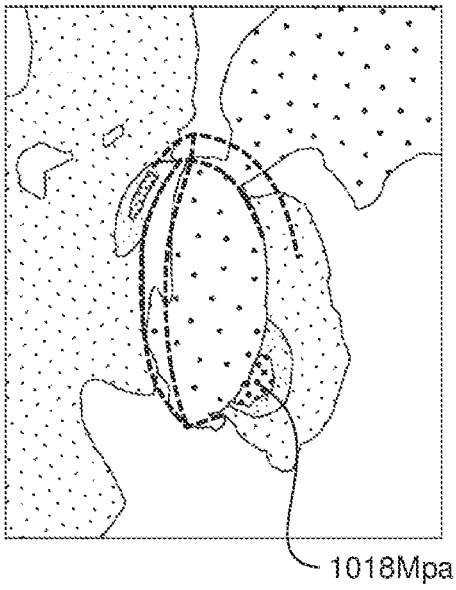
FIG. 6 illustrates a mapping of the static stresses applied to a calibration conduit of oblong section of a calibration device according to the disclosure.

FIGS. 5 and 6 show ISO scale mappings of the static stresses which are the consequence of the loading suffered by the partition (mainly thermal and centrifugal) carrying the calibration conduits 34 through which cooling air passes before passing through the outlet orifices. In FIG. 4 we see in perspective and in front view a conduit of circular transverse section with nominal radius R0 of the prior art and in FIG. 5 it is a conduit with an oblong transverse section with in particular a double radius. We see that with such dimensions and geometries, a comparative analysis by finite element calculation has shown that the localized static stress on a wall portion of the conduit decreases from 1546 Mpa (the small points very close together show the maximum stresses) with a circular hole to 1018 Mpa with an oblong conduit, i.e., a reduction of about 34%.

The invention claimed is:

1. A turbine engine vane, comprising:

a blade with a pressure side wall and a suction side wall that are connected upstream by a leading edge and downstream by a trailing edge;

a cooling circuit which comprises an internal cavity extending inside the blade and a plurality of outlet orifices, each oriented along a longitudinal axis X, each outlet orifice communicating with the internal cavity and being arranged in a vicinity of the trailing edge; and a calibration device disposed within the internal cavity and provided with calibration conduits arranged opposite the plurality of outlet orifices, the calibration conduits each comprising an oblong transverse section perpendicular to the longitudinal axis, wherein the calibration device comprises a calibration cavity disposed downstream of the calibration conduits, the calibration cavity being in fluid communication with the calibration conduits and the plurality of outlet orifices, each calibration conduit comprising a first rectilinear portion and a second rectilinear portion which are opposite along a predetermined width L passing through a central axis A of each calibration conduit, wherein each calibration conduit comprises circular arc portions of a first radius R1 which are symmetrical with respect to a first median plane P1 passing through the central axis A and perpendicular to the predetermined width L, and wherein the circular arc portions are symmetrical with respect to a second median plane P2 passing through the central axis and perpendicular to a predetermined height H of each calibration conduit, wherein first and second ends of each calibration conduit are rounded along a circular arc of a second radius R2, the second radius R2 being less than that of the first radius R1.

2. The vane according to claim 1, wherein the calibration conduits are carried by a partition extending radially in the blade and forming upstream the internal cavity and downstream the calibration cavity, wherein the calibration cavity forms a reservoir.

3. The vane according to claim 1, wherein each first and second rectilinear portion extends over a distance d of 0.2 mm.

4. The vane according to claim 1, wherein each calibration conduit extends over the predetermined height H and wherein the first end and the second end are opposite along the predetermined height.

5. The vane according to claim 4, wherein a ratio of the predetermined height and the predetermined width is between 0.5 and 2.5.

6. The vane according to claim 1, wherein the first radius R1 is equal to twice a nominal radius R0 of a calibration conduit with a circular section, the circular section having a passage area equal to that of the transverse section of each calibration conduit with the oblong transverse section.

7. A turbine of a turbine engine comprising at least one vane according to claim 1.

8. A turbine engine comprising at least one turbine according to claim 7.

9. The vane according to claim 1, wherein the calibration cavity is a single calibration cavity.

10. A turbine engine vane, comprising:

a blade with a pressure side wall and a suction side wall that are connected upstream by a leading edge and downstream by a trailing edge;

a cooling circuit which comprises an internal cavity extending inside the blade and a plurality of outlet orifices, each oriented along a longitudinal axis X, each outlet orifice communicating with the internal cavity and being arranged in a vicinity of the trailing edge; and a calibration device disposed within the internal cavity and provided with calibration conduits arranged opposite the plurality of outlet orifices, the calibration conduits each comprising an oblong transverse section perpendicular to the longitudinal axis, wherein the calibration device comprises a calibration cavity disposed downstream of the calibration conduits, the calibration cavity being in fluid communication with the calibration conduits and the plurality of outlet orifices, each calibration conduit comprising a first rectilinear portion and a second rectilinear portion which are opposite along a predetermined width L passing through a central axis A of each calibration conduit, wherein each calibration conduit comprises circular arc portions which are opposed to each other and symmetrical with respect to a median plane P2 passing through the central axis, each circular arc portion is linked to the first rectilinear portion and a second rectilinear portion, wherein each circular arc portion comprises at least a first radius R1 and a second radius R2, the second radius R2 being less than that of the first radius R1.

* * * * *